US005156485A

United States Patent [19]

Ivey et al.

[11] Patent Number: 5,156,485

[45] Date of Patent: Oct. 20, 1992

[54] LOW PROFILE CONCRETE ROAD BARRIER

[75] Inventors: Don L. Ivey; Hayes E. Ross, both of Bryan; W. Lynn Beason, College Station, all of Tex.

[73] Assignee: Texas A & M University, College Station, Tex.

[21] Appl. No.: 691,392

[22] Filed: Apr. 25, 1991

[51] Int. Cl.[5] ..... E01F 13/00

[52] U.S. Cl. ..... 404/6; 256/13.1

[58] Field of Search ..... 404/6; 256/1, 13.1

[56] References Cited

U.S. PATENT DOCUMENTS

| | | | |
|---|---|---|---|
| 3,643,924 | 2/1972 | Fitch | 256/13.1 |
| 3,674,115 | 7/1972 | Young et al. | 188/32 |
| 3,845,936 | 11/1974 | Boedecker et al. | 256/1 |
| 3,944,187 | 3/1976 | Walker | 256/13.1 |
| 3,982,734 | 9/1976 | Walker | 256/13.1 |
| 4,066,244 | 1/1978 | Yoho | 256/1 |
| 4,198,036 | 4/1980 | O'Neal | 188/32 X |
| 4,307,973 | 12/1981 | Glaesener | 404/6 |
| 4,348,133 | 9/1982 | Trent et al. | 404/6 |
| 4,407,484 | 10/1983 | Meinzer | 256/13.1 |
| 4,605,336 | 8/1986 | Slaw, Sr. | 404/6 |
| 4,661,010 | 4/1987 | Almei et al. | 404/6 |
| 4,815,565 | 3/1989 | Sicking et al. | 188/32 |
| 4,822,208 | 4/1989 | Ivey | 404/6 |
| 4,971,475 | 11/1990 | Castonguay et al. | 404/6 X |
| 5,007,763 | 4/1991 | Burgett | 404/6 |

OTHER PUBLICATIONS

Ivey et al., Portable Concrete Median Barriers: Structural Design and Dynamic Performance, Transportation Research Record 769, pp. 20–30 (1980).

Texas Transportation Institute (authored by Ivey et al.), Barriers in Construction Zones—Vol. 1: Summary Report, pp. 25–28, 53–62 (Apr. 1985).

Southwest Research Institute (authored by Bronstad and Kimball), Temporary Barriers Used in Construction Zones. San Antonio, Task Rpt. (Dec. 1977).

*Primary Examiner*—William P. Neuder

*Attorney, Agent, or Firm*—Arnold, White & Durkee

[57] ABSTRACT

A low profile road barrier that minimizes obstruction to vision and the ramping and rolling of automobiles which may be comprised of one or more interconnected concrete barrier segments stationed along the road or cast in place. The road barrier usually lies substantially parallel to the direction of traffic, may be up to about 24 inches in height and has a sidewall facing toward the road which angles outwardly from the barrier base. Abutting ends of contiguous segments are interconnected by economic, easily installed and removed devices, which preferably comprise bolts with two threaded ends insertable through apertures in the segment ends secured by corresponding nuts.

24 Claims, 5 Drawing Sheets

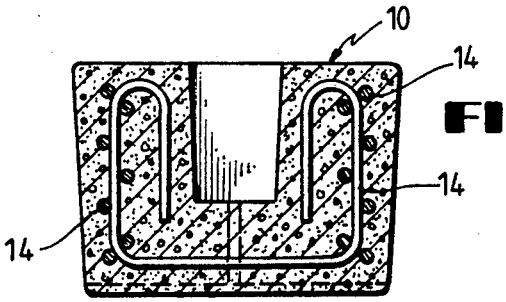
FIG.2B
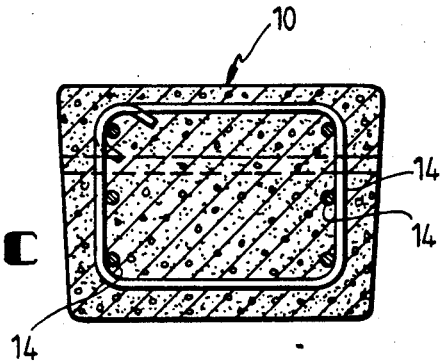
FIG.2C
FIG.3
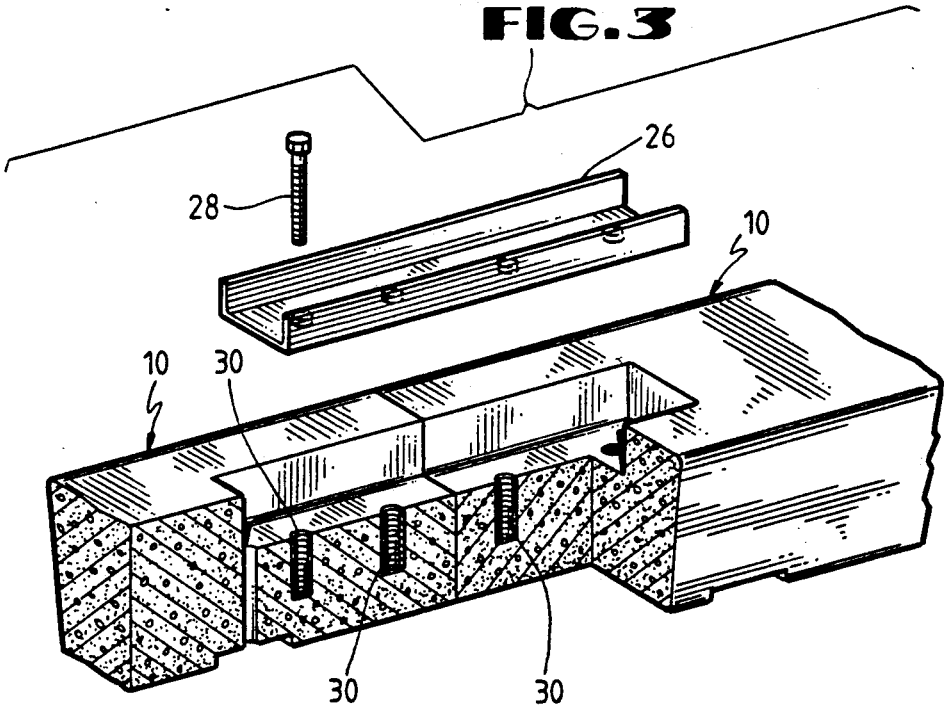

FIG.5
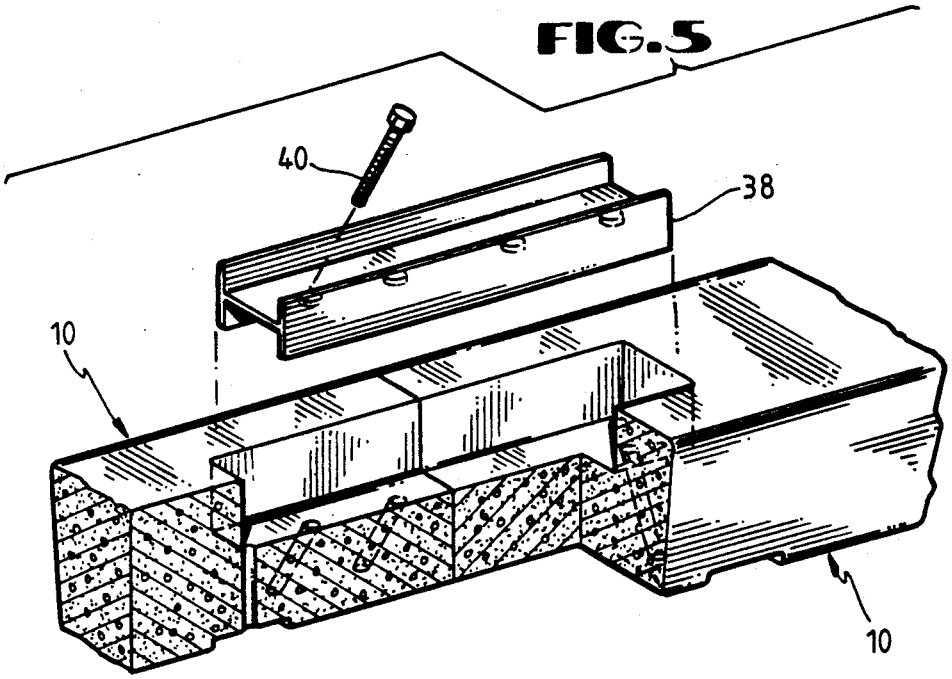
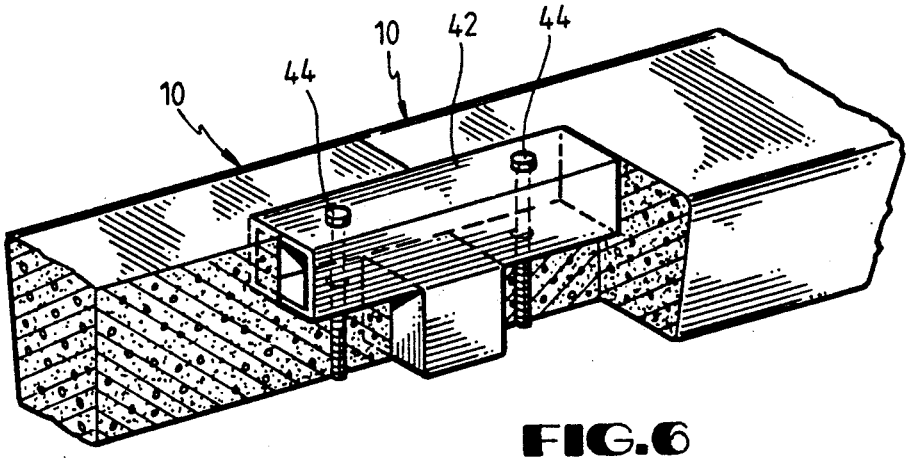
FIG.6

LOW PROFILE CONCRETE ROAD BARRIER

BACKGROUND OF THE INVENTION

1. Field of the Invention

The present invention generally relates to a new and improved concrete road barrier having a low profile to achieve unprecedented visibility for drivers and outer sidewalls facing toward the road which angle outwardly from the barrier base so as to reduce the ramp and roll tendencies of vehicles impacting on the barrier.

2. Description of the Prior Art

Along most highways, there are hazards that present substantial danger to drivers of automobiles if they should happen to leave the highway. To help prevent such accidents, road barriers are often provided along the sides and in the median of a highway to channel the traffic onto appropriate lanes. These barriers are commonly made of concrete, and they slope gradually inwardly from the bottom to the top.

The use of road barriers has several important purposes. First, as noted above, the barriers are intended to channel vehicles hitting the barriers back into the adjacent traffic lanes. Second, the barriers are intended to help prevent vehicles from traveling entirely off the road or into the lanes of opposing traffic. Third, the barriers are intended to be stable and relatively immovable. It is also desirable that the barriers be easily assembled, and that they be weather resistant.

It is recognized that the physical size of many barriers is controlled to a great extent by norms of highway construction. Thus, most modern traffic lanes are designed to be about 12 feet wide. These dimensions, in turn, have caused portable concrete barriers to have a maximum width of about two feet; and they are generally composed of segments about 10 to 30 feet long. The barrier segments are commonly connected end-to-end by lengths of channel iron or angle iron fastened along the sides close to the lower surface of the barriers.

The mass of a barrier is important from the standpoint of resisting movement due to vehicle collisions and redirecting the colliding vehicles, when they strike the barrier. In general, barriers are most effective in handling passenger cars and vehicles of comparable size, especially when they impact the barriers at speeds of 60 mph and lower and at angles between the barrier's longitudinal axis and the vehicle's velocity vector less than about 25 degrees. Large trucks pose a much more difficult problem, since they are capable of simply smashing through barriers. In general, the mass of barriers becomes increasingly important with increasing vehicle size and speed.

The most commonly used barrier at the present time, the "CMB" (concrete median barrier) is a structural concrete barrier which is about two feet wide at its base and tapers inwardly to a height of 32 inches. The barrier at its top is typically about 6 inches wide. The inclined sidewalls of the barrier originally were purposely designed to enable a vehicle to ramp along and up the sidewalls so as to avoid metal damage to the vehicle. While the ramping ability has been considered to be a generally desirable feature, it may give rise to serious problems especially at high vehicle speeds. At these speeds, a vehicle has an increased tendency to climb a barrier and ultimately roll over.

Another problem with existing barriers lies in their height. The height of existing barriers, commonly about 32 inches, is often above or just below the eye level of persons in passenger vehicles — i.e., about 30 to 36 inches above the road surface. Thus, barriers along a road may interfere with visibility of traffic and potential hazards or other obstacles. Blocking of vision by barriers lying between a highway and an access road or entrance ramp can be a particular problem, where the access road or ramp lies on a different plane than the highway.

A further problem with existing barriers involves the cost, attachment difficulties, and maintenance characteristic of current hardware used to join segments of concrete road barriers together.

Accordingly, a need persists for a more economic road barrier which can further reduce the risks of highway travel. Of particular interest are improved visibility and the restriction of vehicles to their proper traffic lanes with improved control and with reduced tendencies to scale barriers and to roll over.

SUMMARY OF THE INVENTION

The present invention in a broad aspect comprises an elongated, concrete road barrier for channelling or controlling the access of traffic that reduces obstruction to vision and the rolling and ramping tendencies of impacting vehicles. The road barrier lies substantially parallel to the direction of traffic movement and is comprised of one or more segments of structural reinforced concrete which (1) measures no more than 24 inches in height, and (2) have outer sidewalls facing the road which angle outwardly from the barrier base. The invention in another aspect comprises a system for interconnecting abutting ends of segments to form a contiguous concrete barrier. The system preferably comprises connectors which are insertable through apertures in the ends of a segment through recesses proximate the ends of the segment. The system also preferably comprises connectors which enable the barrier segments to be laterally articulate.

A further distinctive feature of the barrier of this invention is its large mass relative to existing barriers, even though it is shorter than existing barriers. The new concrete road barrier, for example, weighs up to about 70 percent more than the existing popular "CMB" which is two feet wide at its base and weighs between about 300 and 350 pounds per linear foot. The new barriers, when two feet wide at their base, weigh between about 500 and 600 pounds per linear foot. The additional mass renders the barriers effectively more stable when placed on the ground, thus making them particularly suited to temporary use in construction zones. In addition, the concrete barriers or barrier segments may be affixed to the ground for permanent use along a finished road. The barriers may also be cast in place.

Several advantages over known road barriers emanate from this invention's structural features. One such advantage lies in the low profile of the new road barriers, which markedly reduces obstructions to viewing traffic and other potential hazards in or around the road.

Additional advantages emanate from the outward angling from the barrier base of the sidewalls facing a road traffic lane. The upwardly outward angle of the sidewall helps to make vehicle collisions safer by reducing deflection of the barrier and consequently the rolling and ramping of impacting vehicles. Rolling is especially minimized by the new road barrier, because the barrier usually impacts the wheels of vehicles at or above the center of the wheel hub.

As stated earlier, the control of large trucks and trailers presents an especially difficult problem for road barriers. In that regard, it is contemplated that the barriers of the invention with their greater mass and unique sidewall angles will prove considerably more effective than current conventional barriers in dealing with this problem. Thus, it is expected that large trucks and tractor-trailers will be able to impact the new barriers at higher angles without smashing through or climbing the barriers.

The improved visibility and channeling of traffic provided by the new road barrier is particularly valuable along an access lane lying on a lower plane than the highway into which it feeds traffic. The new road barrier reduces view obstruction between a vehicle on such an access lane merging with highway traffic and the main lane traffic, thereby providing greater road safety.

The safety features of this road barrier are also particularly helpful for improving visibility across the lanes of busy urban intersections, where large volumes of traffic intensify the hazards posed by obstructing the view of fast-flowing vehicles and other obstacles.

BRIEF DESCRIPTION OF THE DRAWINGS

FIG. 2, 2A, 2B, and 2C depict exemplary configurations of reinforcing steel bars which may be used to strengthen the concrete barriers of this invention.

FIG. 3 is an exploded perspective view of an alternative method of connecting barrier segments using channel iron and anchor bolts with threaded inserts.

FIG. 5 is an exploded, partial cutaway, perspective view of an alternative method of connecting barrier segments using an I-beam section fixedly connected to both segments using dowels or anchor bolts with threaded inserts.

FIG. 6 is a partial cutaway, perspective view of an alternative method of connecting barrier segments using a steel-T type connection.

DETAILED DESCRIPTION OF THE INVENTION

Figure 1:
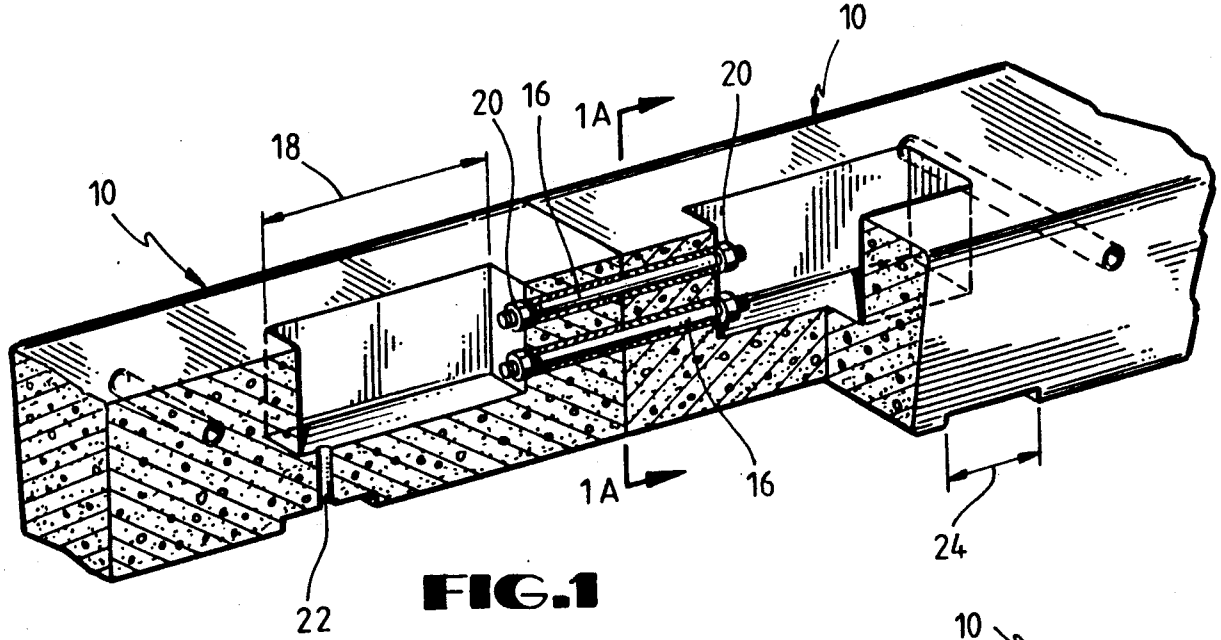
FIG 1 is a perspective partial cutaway view of a preferred embodiment of the present invention showing the connection of two reinforced concrete barrier segments using a pair of connecting bolts.

A preferred embodiment of the present invention is depicted by FIGS. 1, 1A, 2, 2A, 2B, and 2C. Barrier segments 10 are comprised of concrete reinforced by exemplary steel reinforcing bars 14 and includes two ends with apertures 12. Each end of barrier 10 is provided with two threaded bolts 16 inserted through trough 18 into aperture 12 and secured by nut 20. The opposite end of bolt 16 is similarly threaded and similarly extends through aperture 12 and into a trough 18 in an adjacent barrier. Water caught in trough 18 may drain through weep hole 22.

FIGS. 2, 2A, 2B and 2C depict exemplary configurations that reinforcing steel bars 14 in the concrete segment 10 may take. Steel reinforcement is required throughout the barrier segment including both ends, where loads on the connecting bolts cause high load concentration.

In highway construction zones, the concrete barrier segments are typically merely set on the ground. In this mode, the segments may be relocated and are often preformed to include apertures along the base of the barrier segment 24 to permit forklift tines or similar lifting apparatus to move each segment.

Also, however, the barrier segments may be affixed subterraneously by dowels, bolts or other methods in such a way that the barrier is prevented from deflecting significantly. If the barrier segments are anchored to the underlying surface to form a permanent barrier, the troughs 18 may be filled with mortar or other suitable material, thereby helping to protect the bolts 16 or other suitable connectors.

Alternatively, a barrier may be constructed by casting larger sections in place along the designated roadway. Casting may be accomplished using slip forms or conventional wooden forms. As with the preformed segments described above, these larger segments may either be affixed subterraneously by dowels, bolts, and so on, or merely rest on the surface. Additionally, through tie-ins of reinforcing steel, or use of a preformed groove or keyway the cast-in-place sections may be made permanently attached to the surface.

Figure 1A:
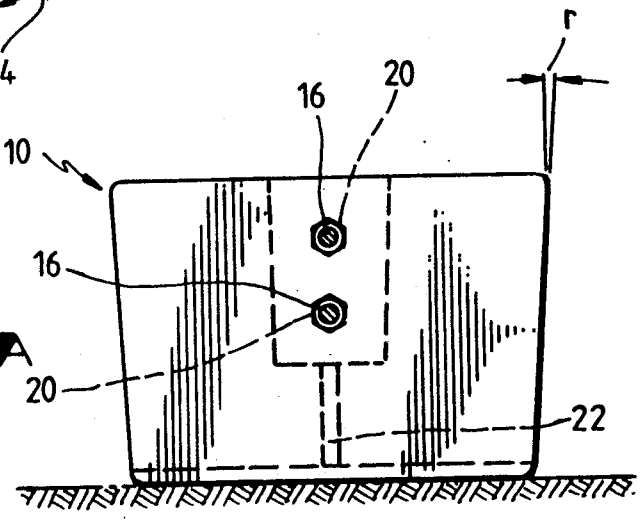
FIG. 1A is a cross-sectional view of a reinforced concrete barrier segment and connecting bolts taken along the section lines 1A—1A of FIG. 1.

As shown especially in FIG. 1A, the barrier sidewalls are angled outwardly from the barrier base. Such an angle r acts to direct the primary thrust of a barrier on a colliding vehicle wheel preferably at or above the center of the wheel hub. In this regard, the wheel diameters of vehicles currently range from about 22 inches for compact automobiles to about 42 inches for large trucks. Thus, a 22-inch tall barrier of the invention will normally be capable of engaging almost all vehicle wheels above the center of the wheels. It is contemplated, however, that those barriers may function at heights as low as twelve inches, even though this height is below the hub center of some autos and large trucks. The visibility advantages provided by the low profile barrier may be recognized with barriers of heights up to 24 inches.

FIGS. 3 through 6 depict alternate arrangements for the connection of barrier segments to achieve the road barrier of the present invention. Referring to FIG. 3, the road barrier of this invention comprises an end-to-end assembly of concrete barrier segments. The segments are connected by means of a section of channel iron 26 which is fixedly attached at either end by means of anchor bolts 28 which are inserted through holes in the channel iron into threaded bolt inserts 30 in each barrier segment 10.

Figure 4:
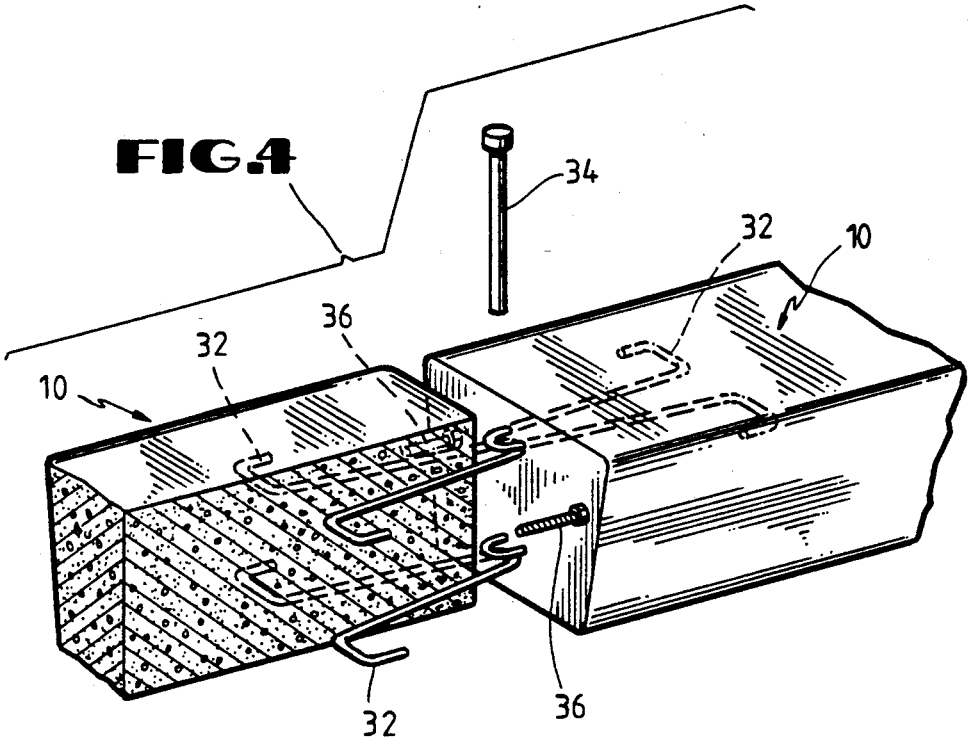
FIGS. 4 and 4A show an alternative method of connecting barrier segments using at least two reinforcing steel segments imbedded in each barrier segment, a connecting pin and a plurality of bolts set in the end of at least one of the barrier segments.
Figure 4A:
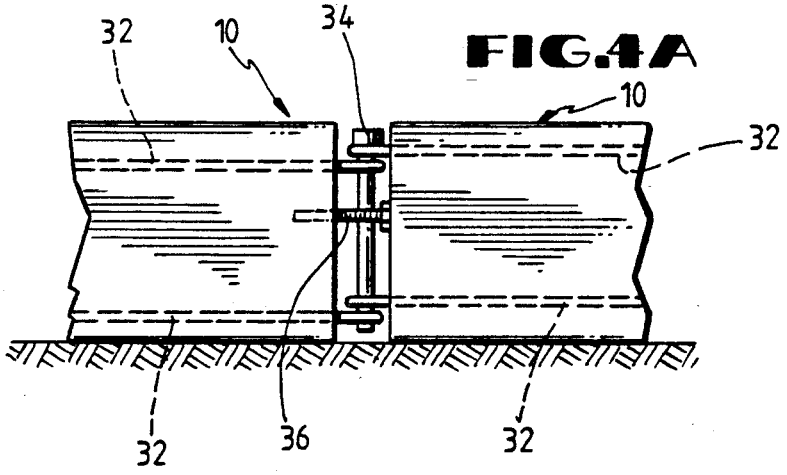

FIGS. 4 and 4A show an alternative method of connecting barrier segments using at least two reinforcing steel segments 32 imbedded in each barrier segment 10, a connecting pin 34 and a plurality of bolts 36 set in the end of at least one of the barrier segments. FIG. 4 is an exploded perspective view of the arrangement showing each of said reinforcing steel segments 32 having been bent to form a protruding eye. FIG. 4A shows the completed connection with the connecting pin placed through each protruding eye. The connection has been stiffened using bolts 36, preset into the end of at least one barrier segment 10, and backed out against the adjacent barrier segment.

FIG. 5 depicts an alternative method for connecting barrier segments to achieve the road barrier of this invention using an I-beam section 38 fixedly connected to both barrier segments 10 using dowels or anchors 40 which are inserted through holes in the I-beam section 38 and into each barrier segment 10.

FIG. 6 shows an alternative method for connecting barrier segments to achieve the road barrier of this invention in which the inner walls and ends of the segments 10 may be joined by a steel T connector 42 as by means of dowels 44 located on each end of the horizontal portion of the steel T connector 42.

The structural concrete used in the invention may typically have conventional compressive strengths of about 2,000 to 6,000 psi and more typically between about 3,000 and 5,000 psi after 28 days of curing. The concrete segments may also be advantageously formed of concrete, pre-stressed with steel cables in accordance with a conventional methods.

The outward angling of at least one sidewall of the segment has an added benefit in simplifying the process for making concrete barriers, which are generally preformed. Conventional barriers having upwardly inward sloping walls require their forms to be overturned; whereas the concrete barriers of this invention may simply be lifted out of their forms.

As noted earlier, the height of the new concrete road barrier may be up to and including about 24 inches. A barrier height of between about 16 and about 20 inches is particularly preferred.

Lengths suitable for concrete road barriers of the invention are widely variable, but the length of each barrier segment is preferably between about 5 and about 30 feet and most preferably between 10 and 20 feet. The suitability of any given length will depend on several factors, including the geometry of the road, and contractor's preferences. The barrier width may also vary widely. The top or base may each measure from about 20 inches to about 30 inches in width, and preferably about 26 inches wide. If less than 20 inches wide, the concrete barriers should be bolted or otherwise permanently affixed to the ground. The top should always be wider than the bottom as explained earlier.

The outer sidewalls of each concrete barrier facing the roadway should be disposed at an angle of between about 60 and about 89 degrees from the transverse axis of the barrier base. This angle is preferably between about 80 and about 88 degrees, and most preferably between about 87 and about 88 degrees. The steeper angles, among other factors, provide for greater mass.

Figure 2:
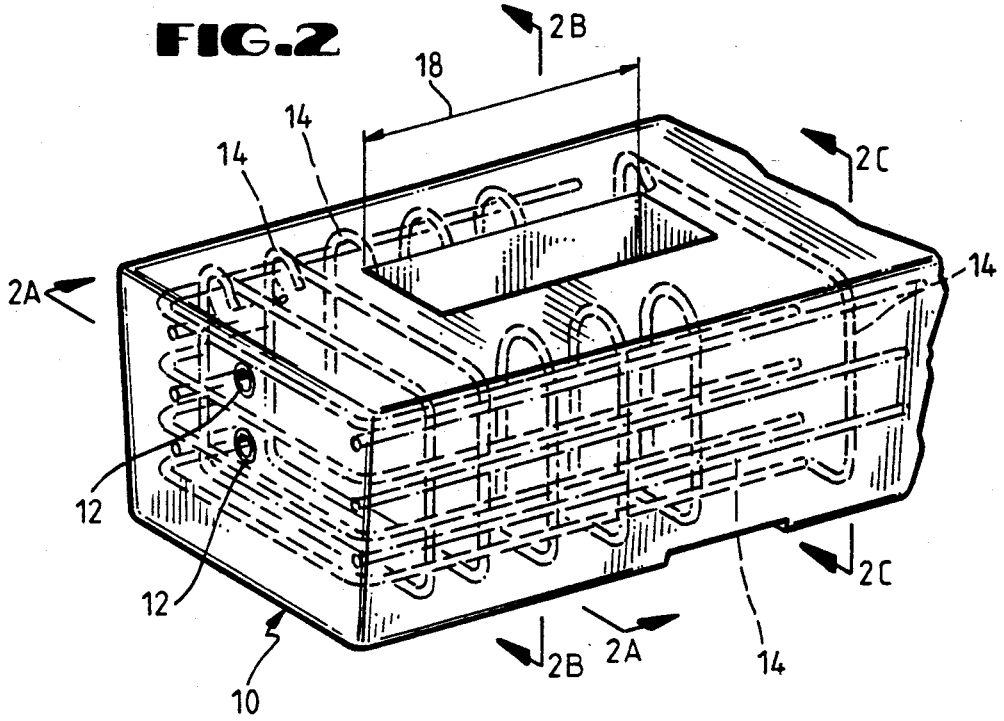
Figure 2A:
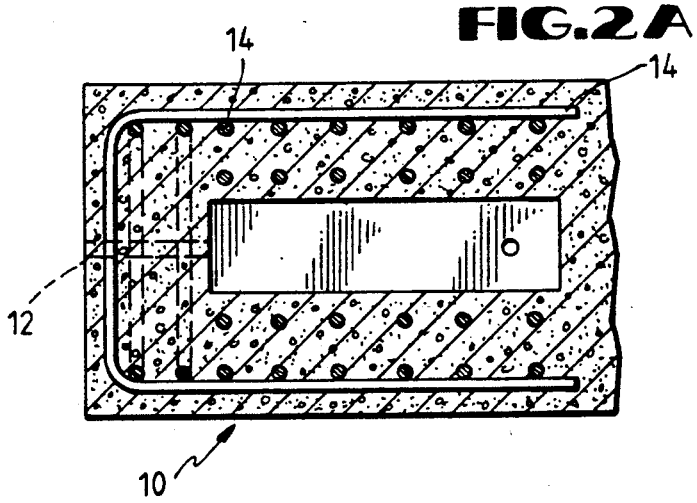

Abutting ends of each concrete barrier may be connected by a number of economic, easily installed and removed devices. As shown in the drawing, the barrier ends are preferably connected as shown in FIG. 1 by bolts 16 having threaded ends which are inserted through aligned apertures 12 in the abutting ends of the barriers. The bolts 16 are secured within each barrier by corresponding nuts 20 which are screwed onto the ends of the bolts within the barriers. As shown in the drawing, a trough or other suitable recess !8 is provided near each end of each barrier, and the bolt apertures 12 extend from the end of the barrier into the recess 18. The recesses are configured to enable the bolts to be inserted into the recesses and thence through the apertures. Sufficient clearance is provided in the apertures to enable the barriers to be adjusted in position — as, for example, to follow around a curve in a highway. The barrier is thereby made laterally articulate. Each recess is preferably spaced from its respective end of its barrier so as to avoid adversely affecting the strength of the barrier, while at the same time enabling the use of strong but readily usable bolts. Reinforcing bars 14 are preferably positioned in the barriers in the vicinity of the recesses to provide adequate strength to the barriers. The bars may take various configurations; several shapes are shown in FIGS. 2–2C.

The bolts for connecting the concrete barriers must be sufficiently large to withstand substantial load. A preferable length has been found to be about 26 inches, with a diameter of about 1¼ inches. Other examples of suitable connective devices include horizontal reinforced steel bar connections with anchor bolts, angle irons, and steel channels as practiced in the art.

The barriers of this invention may be combined with other types of barriers and guard rails. Those sections of roadways which would more appropriately and safely be protected by other barriers such as energy absorbing terminals or crash cushions to guard against head-on collisions.

Compliance tests of the new barrier design were conducted in accordance with guidelines presented in NCHRP Report 230. The tests employed two vehicles — a 1984 Sierra 2500 GMC pickup, and a 1981 Honda Civic. The GMC pickup weighed about 4500 pounds and the Honda Civic weighed about 1965 pounds, both being their gross static weights.

A series of reinforced concrete barrier segments similar to the design shown in FIGS. 1 and 1A were connected end-to-end using pairs of A36 1¼" steel bolts. Each segment was 20 inches high and 20 feet long. Each segment was also two inches wider at its top than at its bottom — i.e., 28 inches versus 26 inches.

Each test vehicle was towed into the barrier using a steel cable guidance and reverse tow system. A steel cable for guiding the test vehicle was stretched along the path, anchored at each end, and threaded through an attachment to the front wheel of the test vehicle. Another steel cable was connected to the test vehicle, passed around a pulley near the impact point, through a pulley on the tow vehicle, and then anchored to the ground such that the tow vehicle moved away from the test site. A 2 to 1 speed ratio between the test vehicle and the tow vehicle existed under this system. The test vehicles were released to be free-wheeling and unrestrained just prior to impact with the barrier.

The GM pickup struck the barrier at a speed of about 44.4 mi/h. (71.4 km/h) and at an angle of about 26.1 degrees. The Honda Civic struck the barrier at a speed of about 45.7 mi/h (73.5 km/h) and at an angle of about 21.3 degrees. In each instance the left front of the vehicle made initial impact.

Each test vehicle was instrumented with transducers, accelerometers and pressure sensitive contact switches to measure such factors as roll, pitch and yaw rates; longitudinal, lateral and vertical acceleration levels; and impact times and velocities. Three high-speed cameras were used to photograph the tests from positions above, behind and in front of the test vehicles.

The barrier received moderate damage from the GM pickup, and only minimal cosmetic damage from the Honda Civic. Each vehicle was redirected by the barrier, and did not penetrate or go over the barrier. There were no detached elements or debris in either instance to show potential for penetration of the occupant compartment or to present undue hazard to other traffic. Each vehicle remained upright and stable with the barrier during impact and after exiting the test installation. Neither vehicle climbed the barrier as would have been the tendency with the CMB barrier. In the case of the GM pickup, the barrier had a maximum lateral movement of about 5 inches (12.7 cm) at the center joint. In the case of the Honda Civic, there was no measurable lateral movement of the barrier.

Many variations and modifications may be made to the longitudinal road barrier described herein without departing from the relevant principles of the invention. Accordingly, it should be readily understood by persons skilled in the art that the scope of this invention is not limited to the specific applications provided in this disclosure but is intended to encompass any embodiment that falls within the scope and spirit of the appended claims.

I claim:

1. A road barrier for use alongside a traffic lane, comprising:

an elongated concrete structure up to about 24 inches in height and having a sidewall facing the lane which angles outwardly from the barrier base.

2. The road barrier of claim 1, wherein said sidewall angles outwardly from the barrier base at an angle of between about 60 and about 89 degrees from the transverse axis of the barrier base.

3. The road barrier of claim 1, wherein the sidewall angles outwardly from the barrier base at an angle of between about 80 and about 88 degrees from the transverse axis of the barrier base.

4. The road barrier of claim 1, wherein the sidewall angles outwardly at an angle of between about 87 and about 88 degrees from the transverse axis of the barrier base.

5. The road barrier of claim 1, wherein the structure is between about 12 and about 24 inches in height.

6. The road barrier of claim 1, wherein the structure is between about 16 and about 24 inches in height.

7. A road barrier for channelling vehicles to stay on or within a safe zone, comprising:

an elongated concrete structure up to about 24 inches high and defining a recess proximate each end of the structure and at least one aperture extending between each recess and its respective end of the structure; each recess and its aperture or apertures configured to enable a connector to be inserted through each aperture via the recess.

8. A road barrier for channelling vehicles to stay on or within a safe lane along a road, comprising:

a. a plurality of steel reinforced concrete barrier segments up to about 24 inches high arranged end-to-end along side the safe lane; each concrete barrier segment having a sidewall facing the lane which angles outwardly from the barrier base, and containing at least two imbedded reinforcing steel segments at either end, each having been bent to form a protruding eye in alignment with a similar protruding eye in the abutting end of the abutting such barrier segment;

b. a connector extending through each pair of aligned protruding eyes to interconnect abutting barriers;

c. a plurality of bolts preset into the end of at least one of the barrier segments and backed out against the adjacent barrier segment.

9. A road barrier for channelling vehicles to stay on or within a safe lane along a road, comprising:

a. a plurality of steel reinforced concrete barrier segments up to about 24 inches high arranged end-to-end along side the safe lane; each concrete barrier segment having a sidewall facing the lane which angles outwardly from the barrier base, and defining a trough proximate each end and an aperture extending from each trough to its respective barrier segment end in alignment with a similar aperture in the abutting end of an abutting such barrier segment;

b. a connector extending through each pair of aligned apertures to interconnect abutting barriers.

10. The road barrier of claim 9 in which the connector is a bolt threaded on at least one end and adapted to be inserted into its pair of apertures through a trough adjacent one of the pair of apertures.

11. The road barrier of claim 8 or 9, wherein the sidewall angles outwardly from the barrier base at an angle of between about 60 and about 89 degrees from the transverse axis of the barrier base.

12. The road barrier of claim 8 or 9, wherein the sidewall angles outwardly from the barrier base at an angle of between about 80 and about 88 degrees from the transverse axis of the barrier base.

13. The road barrier of claim 8 or 9, wherein the sidewall angles outwardly from the barrier base at an angle of between about 87 and about 88 degrees from the transverse axis of the barrier base.

14. A road barrier for channelling vehicles to stay on or within a safe lane along a road, comprising a cast-in-place steel reinforced, concrete barrier up to about 24 inches high adapted to be arranged along side the safe lane; said concrete barrier having a sidewall facing the lane which angles outwardly from the barrier base.

15. The road barrier of claim 14, wherein the sidewall angles outwardly from the barrier base at an angle of between about 60 and about 89 degrees from the transverse axis of the barrier base.

16. The road barrier of claim 14, wherein the concrete barrier is between about 16 and about 24 inches high.

17. The road barrier of claim 14, wherein the sidewall angles outwardly from the barrier base at an angle of between about 80 and about 88 degrees from the transverse axis of the barrier base.

18. The road barrier of claim 14, wherein the sidewall angles outwardly from the barrier base at an angle of between about 87 and about 88 degrees from the transverse axis of the barrier base.

19. A safety barrier for use alongside a traffic lane, which comprises:

an elongated reinforced concrete member up to about 24 inches high and having at least one side wall which slants outwardly from the base of the barrier at an angle of between about 60 and 89 degrees relative to the base of the barrier;

each end of said reinforced concrete member configured to be coupled to one end of another such reinforced concrete member.

20. The safety barrier of claim 19 which further comprises a metal connector embedded at a first end in one end of the reinforced concrete member and adapted at its second end to be coupled to a second such reinforced concrete member.

21. The safety barrier of claim 19 which further comprises a recess proximate each end of the reinforced concrete member adapted to receive one end of a connector capable of coupling the reinforced concrete member end-to-end with another such reinforced concrete member.

22. The safety barrier of claim 21 wherein the recess extends to its respective end of the reinforced concrete member; and wherein the safety barrier further comprises a metal connector configured at each end to be fixed within the recess at the end of the barrier and a similar recess at the end of another such barrier.

23. The safety barrier of claim 22 wherein the metal connector comprises a metal beam adapted to be anchored at each end in a said recess.

24. The safety barrier of claim 19 wherein each said recess is spaced from its respective end of the reinforced concrete member, and wherein said barrier further comprises at least one aperture extending from each said recess to its respective end of the reinforced concrete member.

* * * * *